US006834443B2

(12) United States Patent
Bloemendaal

(10) Patent No.: US 6,834,443 B2
(45) Date of Patent: Dec. 28, 2004

(54) FULL HEAT MOVING TARGET GRAIN DRYING SYSTEM

(75) Inventor: Brent J. Bloemendaal, Zionsville, IN (US)

(73) Assignee: CTB IP, Inc., Wilmington, DE (US)

( * ) Notice: Subject to any disclaimer, the term of this patent is extended or adjusted under 35 U.S.C. 154(b) by 0 days.

(21) Appl. No.: 10/364,249

(22) Filed: Feb. 11, 2003

(65) Prior Publication Data

US 2004/0154184 A1 Aug. 12, 2004

(51) Int. Cl.[7] ..... F26B 21/00

(52) U.S. Cl. ..... 34/491; 34/165; 34/554; 34/524

(58) Field of Search ..... 34/524, 165, 168, 34/174, 65, 550, 491, 554; 426/461, 507, 618

(56) References Cited

U.S. PATENT DOCUMENTS

| | | | | |
|---|---|---|---|---|
| 3,636,638 A | * | 1/1972 | Noyes | 34/529 |
| 3,946,496 A | | 3/1976 | Sukup | |
| 4,149,844 A | * | 4/1979 | Noyes | 432/17 |
| 4,152,840 A | | 5/1979 | Stille | |
| 4,249,891 A | | 2/1981 | Noyes et al. | |
| 4,473,593 A | * | 9/1984 | Sturgeon | 426/461 |
| 4,599,809 A | * | 7/1986 | Parkes | 34/484 |
| 4,750,273 A | | 6/1988 | Parkes et al. | |
| 4,896,795 A | | 1/1990 | Ediger et al. | |
| 4,914,834 A | | 4/1990 | Sime | |
| 4,916,830 A | | 4/1990 | Braun et al. | |
| 5,136,791 A | | 8/1992 | Fraile et al. | |
| 5,144,755 A | | 9/1992 | Braun et al. | |
| 5,189,812 A | * | 3/1993 | Ediger | 34/565 |
| 5,551,168 A | * | 9/1996 | Van Fossen | 34/491 |
| 5,570,521 A | | 11/1996 | Baker et al. | |
| 5,651,193 A | | 7/1997 | Rhodes et al. | |
| 5,653,043 A | | 8/1997 | Bestwick et al. | |
| 6,070,520 A | * | 6/2000 | Kannenberg et al. | 99/468 |
| 6,233,842 B1 | | 5/2001 | Geelan | |
| 6,260,479 B1 | | 7/2001 | Friedrich et al. | |
| 6,318,000 B1 | | 11/2001 | Satake et al. | |

* cited by examiner

*Primary Examiner*—Kenneth Rinehart
(74) *Attorney, Agent, or Firm*—Harness, Dickey & Pierce, P.L.L.C.

(57) ABSTRACT

A grain dryer control system uses the grain dryer discharge temperature to account for moisture reduction in the grain as it cools after discharge from the dryer. The control system includes moisture and temperature sensors and a means to control the discharge of grain from the grain dryer. Given a grain discharge temperature, a control temperature and a moisture reduction factor as a function of temperature, the control system calculates an expected moisture reduction in the grain as the grain cools. Grain is discharged from the dryer when the target moisture content after cooling added to the expected moisture reduction in the grain as the grain cools meets the measured grain moisture content in the dryer.

31 Claims, 3 Drawing Sheets

FULL HEAT MOVING TARGET GRAIN DRYING SYSTEM

FIELD OF THE INVENTION

The present invention relates generally to grain drying systems and more particularly to an automated method and control system for achieving a target grain moisture content.

BACKGROUND OF THE INVENTION

The moisture content of freshly harvested grain must be lowered before storage to prevent spoilage. A moisture content of 15 percent is considered optimum by commercial grain elevator operators for long term storage of the grain when the grain is exposed to air, and 14 percent is preferred to retard spoilage of stored grain where access to air is limited. The removal of too much moisture is wasteful of drying energy and usually results in shrinkage which decreases the value of grain. If the moisture is removed too rapidly, damage to the grain results. A continuous flow grain dryer is typically operated by forcing high amounts of heated air through a moving layer of grain in a grain dryer. Typical grain dryers and control systems thereof are disclosed in U.S. Pat. Nos. 4,194,844, 4,750,273, 5,570,521, and 5,651,193, the disclosures of which are hereby incorporated by reference in their entirety.

A grain dryer can be configured to heat grain to drive off unwanted moisture then to cool the grain. Alternatively, full heat drying can be employed whereby grain is heated within a grain dryer to a preselected temperature or moisture content and discharged to cool outside the dryer. Some moisture will be driven out of the kernels as the grain cools. This amount of moisture reduction is predictable as long as the cooling time is consistent and several hours in length. The amount of moisture reduction in grain per unit of temperature reduction as it cools is an essentially constant value for most grains and is known as a bin factor. The specific bin factor for a drying operation is dependent on the ambient temperature and humidity (i.e. one would expect that a bin factor for a moist climate, such as Quebec, would differ from a bin factor from a similar drying operation in a dryer climate, such as Nebraska).

Typical automated control systems for full heat dryer operations use either grain moisture or temperature to determine when grain is removed from the dryer. In a moisture based system, an automated controller detects the grain moisture content and the grain is discharged when a target moisture content is met. In a temperature based system, the temperature of grain near the discharge is determined and the discharge rate is adjusted if a pre-selected temperature is not met. A typical moisture based control system is disclosed in U.S. Pat. No. 4,916,830.

For both temperature and moisture based systems, an operator manually factors in the bin factor, i.e., the additional amount of moisture that should be removed from the grain in the bin per unit temperature during the cooling process. In both systems, the operator must be capable of measuring or approximating data about the moisture content and temperature at the discharge to calculate the final moisture content expected in the bin after the grain cools down. This information is used to manually adjust the target discharge temperature or moisture content—as the case may be—to account for the bin factor. Typically, this adjustment to a grain dryer automatic controller is made when grain from a different field is fed into the dryer, or when a grain with a variable moisture content is expected.

The bin factor that is used in conventional grain drying operations is selected from charts or from historical data from a previous, similar operation. Typically, an operator will measure the moisture content and temperature of a sample of grain both as it is discharged from a grain dryer and after cooling. By dividing the change in moisture content by the change in temperature, an approximate bin factor can be determined and used for subsequent drying operations. For corn, a bin factor of 0.5 percent of moisture reduction per 10 degrees Fahrenheit (above 80° F.) is typical. As an example, in a moisture based system, the operator desires a moisture content of 14%. Using a historical bin factor of 0.5 percent moisture reduction per 10 degrees Fahrenheit, an estimated grain dryer discharge temperature of 140° F., and an ambient, or control, temperature of 80° F., the operator manually calculates an expected moisture reduction of 3% [(0.5 percent moisture reduction per 10 degrees Fahrenheit) multiplied by ((140° F.–80° F.) divided by 10)]. The operator then adds this expected 3% to the target 14% to arrive at a 17% moisture content desired at the dryer discharge. The operator then adjusts the dryer controller to discharge grain at 17% moisture content. This method would be adequate if the grain were to discharge from the dryer at a consistent 17% moisture content and 140° F. In operation, a conventional moisture based system will discharge grain at a moisture content of 17%, regardless of temperature.

With moisture based control, grain discharged with a consistent moisture content may vary considerably in temperature. With a constant bin factor, kernels will emit different amounts of moisture while cooling, resulting in cooled grain that varies considerably in moisture content. In temperature based control, grain may leave the dryer with a consistent temperature, but vary considerably in moisture content. With a constant bin factor, all kernels will emit identical amounts of moisture, resulting in grain that also varies in moisture content.

These problems are particularly acute with newer, hybrid grains which tend to exhibit considerable variation in as-harvested moisture content and drying rate. In addition to the ambient conditions that affect cooling moisture reduction rates mentioned previously, inconsistent drying rates both within the dryer and during cooling are also associated with variances in maturity, seed coat permeability and thickness of the grain. Thus, unless an operator is prepared to continually monitor the output data and make the bin factor adjustment throughout the drying process, variations in the final moisture content in the storage bin will occur.

What is needed is a completely automated method whereby grain can be discharged from a grain dryer to achieve a preselected moisture content or moisture content range in the grain storage bin, without the need for manual calculation with respect to the bin factor.

SUMMARY OF THE INVENTION

The present invention is directed to a moisture based grain dryer control system and method that uses the dryer outlet grain temperature to account for additional moisture reduction during cooling. In one aspect of the present invention, a method is provided wherein grain moisture content and temperature within a grain dryer is periodically detected and the expected moisture removal for the corresponding temperature and bin factor are calculated. Grain is discharged from the grain dryer as the expected post cooling moisture content added to a desired target moisture content is within a tolerance of the measured moisture content within the dryer.

In another aspect, the present invention provides an electronic system whereby a dryer module receives input from a user interface and various temperature and moisture content sensors of a grain dryer. The dryer module periodically calculates an expected post cooling moisture content and generates a signal to control the rate of discharge of grain to a measured moisture content and temperature sufficient to dry down while cooling to the target value.

In another aspect, the present invention provides a control system for a grain dryer wherein parameters of a material being dried are measured and a known target moisture content is compared to a measured moisture content and an expected cooling bin moisture reduction amount.

In yet another aspect, the present invention provides a grain dryer wherein a control system measures parameters of a material being dried and a known target moisture content is compared to a measured moisture content and an expected cooling bin moisture reduction amount.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
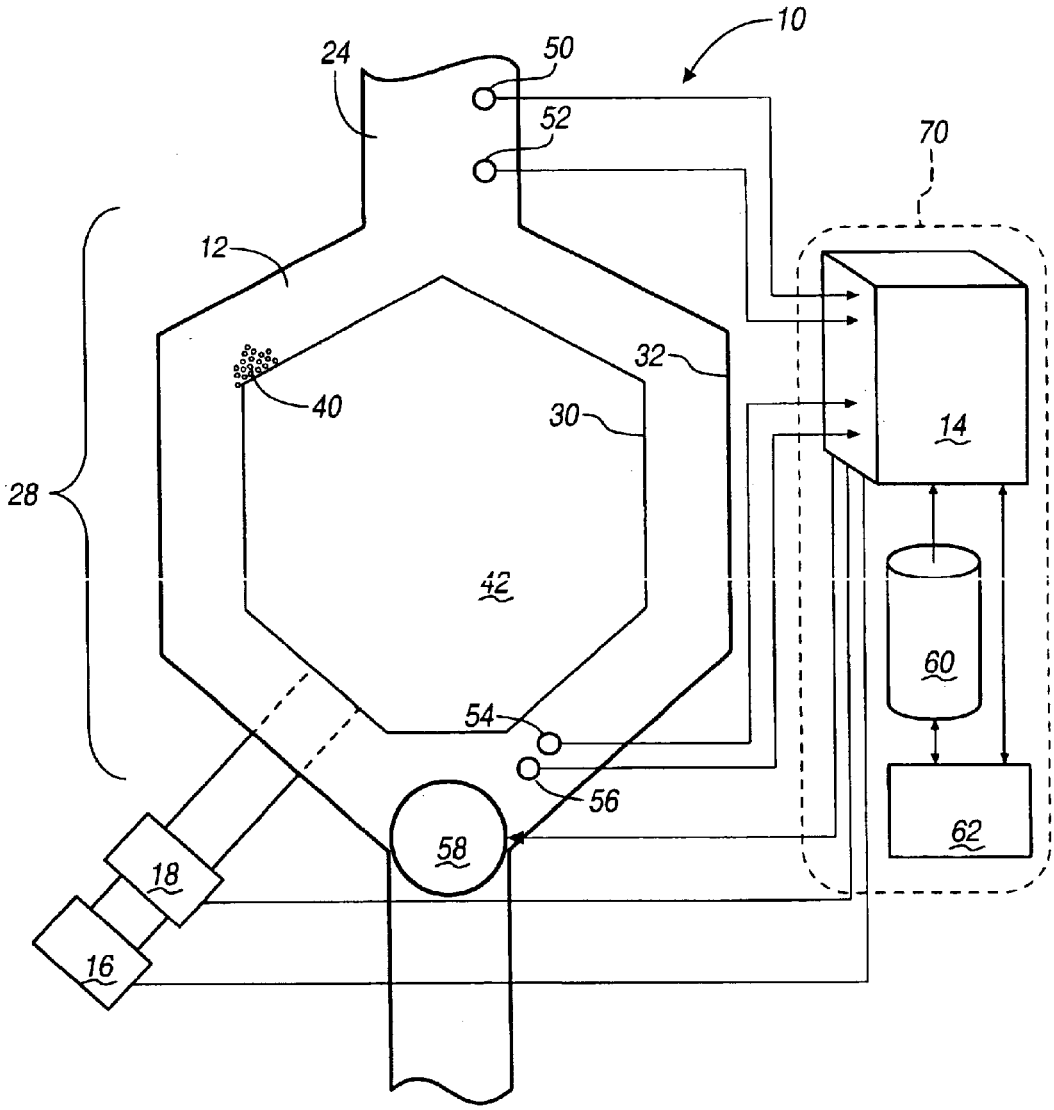
FIG. 1 illustrates a grain dryer and control system in accordance with a preferred embodiment of the present invention.

FIG. 1 illustrates a continuous flow grain dryer 10. Dryer 10 includes a grain chamber 12, a dryer control module 14, a fan 16, and a heater 18. Grain chamber 12 includes a grain inlet portion 24, a discharge, or outlet 26 and a drying portion 28 defining an interior wall 30 and an exterior wall 32. Grain 40 is gravity fed into inlet portion 24 and allowed to travel through the drying portion 28 and outlet 26 of the grain chamber 12. Interior and exterior walls 30, 32 are perforated such that a drying gas can flow therethrough. Preferably the drying gas is air that is forced by fan 16 through heater 18 and into a central plenum 42 of the dryer 10 defined by interior wall 30. Thus provided, heated air can flow through interior wall 30 to exterior wall 32 in communication with grain 40 for the purpose of evaporative reduction of the moisture content of grain 40.

Dryer control module 14 is in communication with an inlet temperature sensor 50, an inlet moisture sensor 52, a discharge temperature sensor 54, a discharge moisture sensor 56, a grain flow controller 58, a data storage 60, a user interface 62, fan 16 and heater 18. Sensors 50, 52, 54 and 56 provide input to dryer control module 14 related to the change in temperature and moisture content of grain 40 while passing through dryer 10. Collectively, dryer control module 14, data storage 60 and user interface 62 comprise a control system 70. User interface 62 includes a readout display and a keypad which can be used to view and/or input information in data storage 60. This information includes a target post cooling moisture and/or a target post cooling moisture range and a bin factor. Dryer control module 14 can receive inputs from sensors 50, 52, 54 and 56, data storage 60 and user interface 62. Dryer control module 14 can also generate an output signal to fan 16, heater 18 and grain flow controller 58 in order to control the drying rate and/or flow rate of grain 40 in the grain chamber 12. It will be recognized by one skilled in the art that data storage 60, while preferably a computer-readable memory, could also comprise a modem or other means to access data for use in dryer control module 14.

Figure 2:
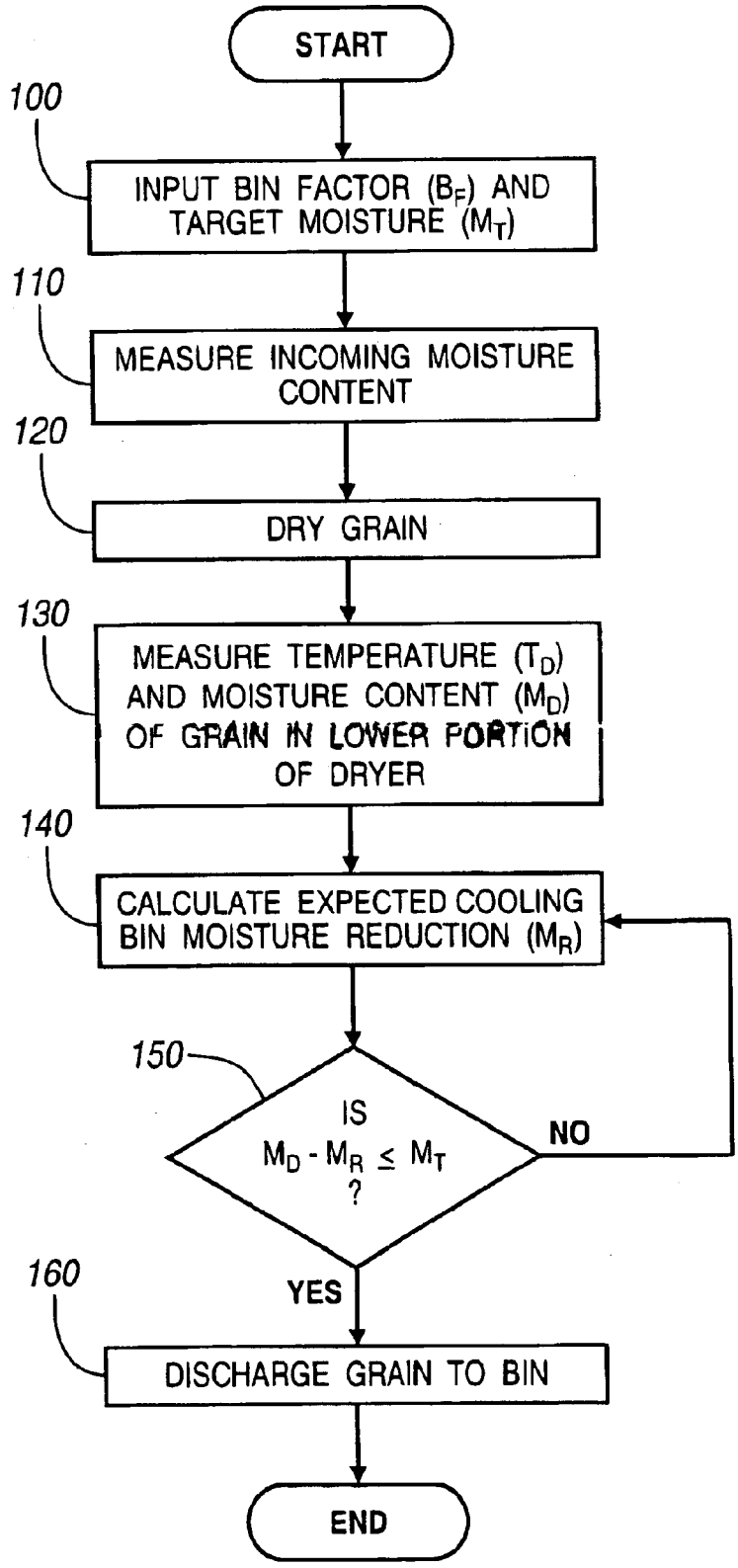
FIG. 2 is a flow chart illustrating a preferred embodiment of the method of the present invention.

FIG. 2 is a flow chart illustrating the process steps of a batch-type dryer using the method of the present invention. In step 100, dryer control module 14 (FIG. 1) receives a signal representing a selected bin factor and a signal representing a desired post cooling target moisture. Preferably, the bin factor is input in user interface 62, but alternately, a correction factor may be input in user interface 62 wherein the correction factor is used to adjust a preset bin factor. Briefly, the bin factor is the amount of moisture reduction the heated grain experiences as it cools from the dryer discharge temperature per unit of temperature reduction. For corn, a typical bin factor is approximately 0.5 percent moisture reduction for each 10° F. of post dryer cooling, when allowed to cool over a period of several hours. While the bin factor is described in units of percent moisture reduction for each 10° F. of post dryer cooling, it would be recognized by one skilled in the art that the bin factor can be any coefficient or equation that is representative of the rate or amount of moisture reduction after grain 40 is discharged from dryer 10.

In step 110, inlet moisture sensor 52 detects the moisture content and sends a representative signal to dryer control module 14. Dryer control module 14 receives the signal from inlet moisture sensor 52 and determines an initial temperature set point for heater 18 which is a function of inlet grain moisture, target moisture and desired flow rate. In step 120, dryer 10 is filled with grain 40 while fan 16 forces air through heater 18 and past grain 40 causing grain 40 to experience an evaporative moisture content reduction. Sensors 54, 56 detect the temperature and moisture content of grain 40 as it passes through dryer 10 and send representative signals to the dryer control module 14. Preferably sensors 54, 56 are located between walls 30, 32 within the lower 1/16 of dryer portion 28 near outlet 26.

In step 130, dryer control module 14 preferably receives input from sensors 50, 52, 54 and 56 every hour, and more preferably, on a frequency of 1 to 2 seconds. In step 140, dryer control module 14 calculates the expected moisture reduction, as a function of the bin factor, if grain 40 were allowed to cool from the temperature detected by sensor 54 to a control ambient temperature. Preferably, the control ambient temperature is set at 80° F., although an actual ambient temperature or other control temperature may be selected. The process proceeds to step 150, wherein dryer control module 14 subtracts the expected moisture reduction from the moisture content detected by sensor 56 and determines or calculates whether this estimated cooling bin moisture reduction amount is less than or equal to the target post cooling moisture value or within an acceptable tolerance of the target post cooling moisture value. If the result of the determination of step 150 is affirmative, the process proceeds to step 160. If the result of the determination of step 150 is negative, the process returns to step 140 after a prescribed time interval.

Figure 3:
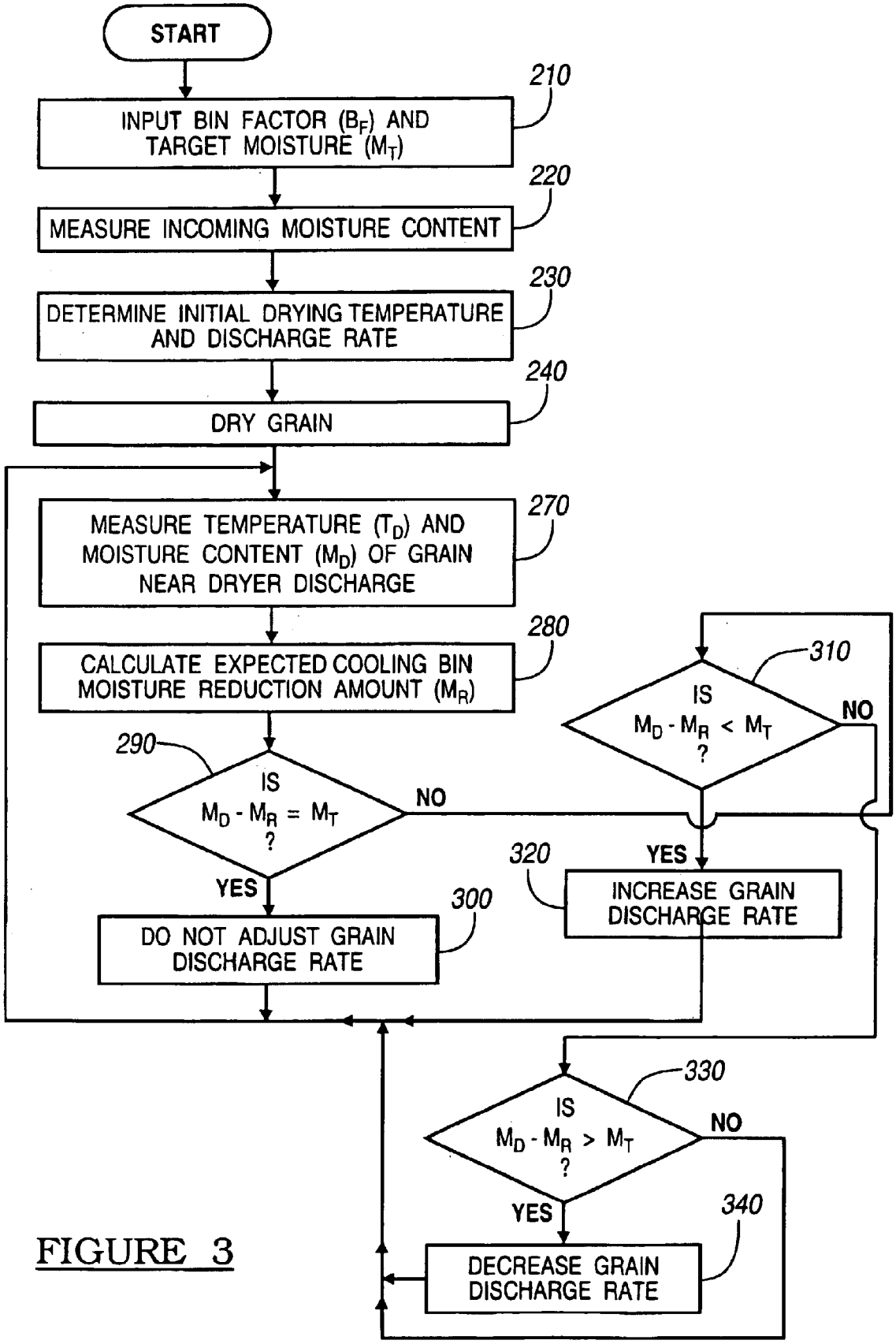
FIG. 3 is a flow chart illustrating an alternate embodiment of the method of the present invention.

FIG. 3 is a flow chart illustrating the process steps of a continuous flow type dryer using the method of the present invention. In step 210, dryer control module 14 (FIG. 1) receives a signal representing a selected bin factor and a signal representing a desired post cooling target moisture. In step 220, inlet moisture sensor 52 detects the moisture content and sends a representative signal to dryer control module 14. In step 230, dryer control module 14 receives the signal from inlet moisture sensor 52 and determines an initial temperature set point for heater 18 and desired flow rate which is a function of inlet grain moisture, target moisture and desired flow rate. In step 240, dryer 10 is filled with grain 40 while fan 16 forces air through heater 18 and past grain 40 causing grain 40 to experience an evaporative moisture content reduction.

In step 270, sensors 54, 56 detect the temperature and moisture content of grain 40 as it passes through dryer 10 and send representative signals to the dryer control module 14. In step 280, dryer control module 14 calculates the expected moisture reduction, as a function of the bin factor, if grain 40 were allowed to cool from the temperature detected by sensor 54 to a control ambient temperature. Preferably, the control ambient temperature is set at 80° F., although an actual ambient temperature or other control temperature may be selected. The process proceeds to step 290, wherein dryer control module 14 subtracts the expected moisture reduction from the moisture content detected by sensor 56 and determines or calculates whether this estimated cooling bin moisture reduction amount is equal to the target post cooling moisture value or within an acceptable tolerance of the target post cooling moisture value. If the result of the determination of step 290 is affirmative, the process proceeds to step 300. If the result of the determination of step 290 is negative, the process proceeds to step 310. In step 300, the signal to grain flow controller 58 is unchanged and the process returns to step 270 after a prescribed time interval.

In step 310, dryer control module 14 subtracts the expected moisture reduction from the moisture content detected by sensor 56 and determines or calculates whether this estimated cooling bin moisture reduction amount is less than the target post cooling moisture value or an acceptable tolerance of the target post cooling moisture value. If the result of the determination of step 310 is affirmative, the process proceeds to step 320. If the result of the determination of step 310 is negative, the process proceeds to step 330. In step 320, the signal to grain flow controller 58 is changed such that the grain discharge rate is increased and the process returns to step 270 after a prescribed time interval.

In step 330, dryer control module 14 subtracts the expected moisture reduction from the moisture content detected by sensor 56 and determines or calculates whether this estimated cooling bin moisture reduction amount is greater than the target post cooling moisture value or an acceptable tolerance of the target post cooling moisture value. If the result of the determination of step 330 is affirmative, the process proceeds to step 340. If the result of the determination of step 330 is negative, the process proceeds to step 270 after a prescribed time interval. In step 340, the signal to grain flow controller 58 is changed such that the grain discharge rate is decreased and the process returns to step 270 after a prescribed time interval.

Preferably, the estimated cooling bin moisture reduction amount determination is performed on a periodic basis; and even more preferably at a constant time interval. In addition, this determination is preferably performed at least about once every hour; and more preferably, at least about once every 30 minutes; more preferably at least about once every minute, and even more preferably, at least about once every 1.5 seconds. Further, this determination in the discharge decision is preferably based upon recently sensed data. Preferably, the data has been sensed within about the last hour; more preferably within about the last 30 minutes; more preferably, within about the last minute; and even more preferably, within about the last 1.5 seconds. In step 160, dryer control module 14 sends a signal to grain flow controller 58 to allow the discharge of drain 40 from dryer portion 28 through outlet 26.

In operation, dryer control module 14 preferably receives input from sensors 54, 56 with a frequency that allows grain flow controller 58 to prevent grain 40 from reaching outlet 26 before grain 40 attains a condition (with respect to moisture content and temperature) wherein the actual bin factor will result in a post cooling moisture content that is within an acceptable range of a target moisture content. Also preferably the flow of grain 40 through dryer 10 is regulated by dryer control module 14 in such a manner so as to be a continuous flow that has a flowrate alterable by grain flow controller 58. In this manner, grain 40 is dried in dryer 10 to a moisture content that is a function of the grain temperature at that moisture content, a bin factor, and a target moisture content. The grain 40 is then transferred to a location where subsequent cooling will produce an actual post cooling moisture content range that is within a lower tolerance of the desired in-bin moisture content produced by conventional grain drying control systems.

It would be recognized by one skilled in the art that sensors 50, 52, 54, or 56 could be an array of sensors that send an averaged input signal to dryer control module 14 or a plurality of sensors dispersed throughout the applicable dryer 10 region that send multiple signals to dryer control module 14 that are averaged or otherwise analyzed by dryer control module 14 to obtain a representative moisture or temperature of grain 40. In addition, one skilled in the art will recognize that target moisture content as used herein, both with respect to the grain near the discharge and in the storage bin, includes target moisture content ranges. It would also be recognized by one skilled in the art that the invention described herein could be utilized with both a batch-type or continuous flow grain dryer. To be within an acceptable range of the target moisture content, the moisture content is preferably within about 1 percent of the target moisture content, and more preferably, within about 0.5 percent.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for drying grain in a grain dryer having a drying portion, wherein the drying portion is adapted to expose the grain to a drying gas for reducing the moisture content of the grain comprising the steps of:

moving grain through the grain dryer;

sensing the moisture content of the grain within the drying portion;

sensing the temperature of the grain within the drying portion;

automatically determining an expected cooling bin moisture reduction amount as a function of the temperature sensed within the drying portion; and controlling the discharge of the grain from the drying portion to achieve a target moisture content range in a storage bin after taking into account the automatically determined expected cooling bin moisture reduction amount.

2. The method of claim 1 wherein automatically determining an expected cooling bin moisture reduction amount comprises performing a calculation using a bin factor, a sensed temperature and a control temperature.

3. The method of claim 1 wherein automatically determining an expected cooling bin moisture reduction amount comprises multiplying a bin factor by the difference between a sensed temperature adjacent an outlet portion and an in-bin control temperature.

4. The method of claim 1 wherein automatically determining the expected cooling bin moisture reduction amount is performed at predetermined periodic intervals.

5. The method of claim 1 wherein automatically determining the expected cooling bin moisture reduction amount is performed at least about once every hour.

6. The method of claim 1 wherein automatically determining an expected cooling bin moisture reduction amount uses a temperature recently sensed within an outlet portion.

7. A system for use with a grain dryer comprising:

a moisture content input receptive of a signal from a moisture sensor;

a temperature input receptive of a signal from a temperature sensor; and a moisture control module adapted to generate a grain discharge control signal in response to a moisture control module calculation based upon the temperature input and the moisture content input indicating that a target storage moisture content range will be achieved in a storage bin after the grain cools.

8. The system of claim 7 further comprising a data storage adapted to receive, store and transmit information, wherein said data storage is in communication with the moisture control module.

9. The system of claim 7 further comprising an additional moisture sensor representative of the moisture content of grain that has not been dried.

10. The system of claim 7 wherein the moisture control module is adapted to perform the calculation based upon the temperature input and the moisture content input at a predetermined periodic time interval.

11. The system of claim 7 wherein the moisture control module is adapted to perform the calculation based upon the temperature input and the moisture content input at least about once every hour.

12. A control system for a grain dryer comprising:

a grain moisture content sensor;

a grain temperature sensor;

a discharge controller; and a dryer controller comprising a computer-readable memory, the dryer controller being in communication with the grain moisture sensor, the grain temperature sensor, and the discharge controller, wherein the dryer controller is adapted to account for a delta to the sensed grain moisture content based upon an expected cooling bin moisture reduction amount as a function of a sensed grain temperature and information stored in the computer-readable memory in the operation of the discharge controller.

13. The control system of claim 12 wherein the computer-readable memory contains values representative of a desired moisture value and a bin factor.

14. The control system of claim 12 wherein the dryer controller is further adapted to calculate the delta at a periodic interval.

15. The control system of claim 12 wherein the dryer controller is further adapted to calculate the delta at least about once every hour.

16. A grain dryer comprising:

a grain chamber through which grain to be dried is moved toward a grain discharge outlet;

a drying unit adapted to communicate a heated gas through the grain in the grain chamber;

a moisture sensor for sensing the moisture content of grain within the grain chamber;

a temperature sensor for sensing the temperature of grain within the grain chamber;

a discharge controller to control the flow of grain through the grain dryer; and a dryer controller comprising a computer-readable memory, the dryer controller being in communication with the moisture sensor, the temperature sensor and the discharge controller, wherein the dryer controller is adapted to calculate an expected cooling bin moisture reduction amount as a function of the temperature sensed by the temperature sensor and information stored in the computer-readable memory and to operate the discharge controller to achieve a desired target storage moisture content by accounting for the calculated expected cooling bin moisture reduction amount.

17. The grain dryer of claim 16 wherein the computer-readable memory contains values representative of a desired target storage moisture content and a bin factor.

18. The grain dryer of claim 17 wherein the dryer controller is further adapted to compare a measurement from the moisture sensor to a sum of the expected cooling bin moisture reduction amount and the desired target storage moisture content.

19. The grain dryer of claim 16 wherein the dryer controller is further adapted to calculate the expected cooling bin moisture reduction amount at a periodic interval.

20. The grain dryer of claim 16 wherein the dryer controller is further adapted to calculate the expected cooling bin moisture reduction amount at least about once every hour.

21. The grain dryer of claim 16 further comprising an input moisture content sensor adjacent a grain inlet to the grain chamber wherein the dryer controller is further adapted to control a temperature of the heated gas based upon the difference in sensed temperature between the input moisture content sensor and a discharge moisture content sensor.

22. The method of claim 1 wherein controlling the discharge of the grain provides a batch drying process.

23. The method of claim 1 wherein controlling the discharge of the grain provides a continuous flow drying process.

24. The method of claim 1 wherein sensing the temperature of the grain includes sensing the temperature of the grain adjacent an outlet portion of the grain dryer.

25. The system of claim 7 wherein a discharge controller is adapted to initiate a flow of grain within the grain dryer through a discharge outlet of the grain dryer in response to the grain discharge signal.

26. The system of claim 7 wherein a discharge controller is adapted to adjust a flowrate of grain within the grain dryer through a discharge passage of the grain dryer in response to the grain discharge signal.

27. The control system of claim 12 wherein the discharge controller is adapted to initiate a flow of grain through a discharge outlet of the grain dryer as part of a batch grain drying process.

28. The control system of claim 12 wherein the discharge controller is adapted to adjust a flowrate of grain through a discharge outlet of the grain dryer as part of a continuous flow grain drying process.

29. The control system of claim 12 wherein the grain temperature sensor is located adjacent a discharge outlet controlled by the discharge controller.

30. The grain dryer of claim 16 wherein the discharge controller is adapted to initiate a flow of grain through a discharge outlet of the grain dryer as part of a batch grain drying process.

31. The grain dryer of claim 16 wherein the discharge controller is adapted to adjust a flowrate of grain through the grain discharge outlet of the grain dryer as part of a continuous flow grain drying process.

* * * * *